United States Patent [19]

Priskich

[11] Patent Number: 4,592,568

[45] Date of Patent: Jun. 3, 1986

[54] SKI BOOT MOUNTING STRUCTURE FOR FACILITATING MONOSKIING ON SNOW

[76] Inventor: Damir R. Priskich, 263 Bella Vista Way, San Francisco, Calif. 94127

[21] Appl. No.: 633,327

[22] Filed: Jul. 23, 1984

[51] Int. Cl.[4] ..... A63C 5/00

[52] U.S. Cl. ..... 280/607

[58] Field of Search ..... 280/602, 607, 617, 618

[56] References Cited

U.S. PATENT DOCUMENTS

| | | | |
|---|---|---|---|
| 3,300,226 | 1/1967 | Reed, Jr. | 280/602 |
| 3,790,186 | 2/1974 | Kanno | 280/617 |
| 3,802,714 | 4/1974 | Freegard | 280/607 |
| 3,854,738 | 12/1974 | Fish | 280/607 |
| 4,022,491 | 5/1977 | Powell | 280/607 X |

FOREIGN PATENT DOCUMENTS

| | | | |
|---|---|---|---|
| 2007366 | 9/1970 | Fed. Rep. of Germany | 280/607 |
| 604766 | 9/1978 | Switzerland | 280/607 |
| 621483 | 2/1981 | Switzerland | 280/607 |

*Primary Examiner*—John J. Love
*Assistant Examiner*—Michael Mar
*Attorney, Agent, or Firm*—Townsend and Townsend

[57] ABSTRACT

A monoski having a mounting structure including forward and rear platform elements for side-by-side ski bindings for supporting a skier on a raised platform for downhill monoskiing. The forward and rear platform elements are interconnected by a flexible member, such as a leaf spring, for strengthening the mounting structure and absorbing both upward and downward deflection of the ski.

18 Claims, 4 Drawing Figures

SKI BOOT MOUNTING STRUCTURE FOR FACILITATING MONOSKIING ON SNOW

BACKGROUND OF THE INVENTION

This invention relates generally to snow skis and, more particularly, to skis for downhill or alpine skiing. Specifically, the invention is directed to a snow monoski for enabling a skier to ski on snow with only one ski and in particular to a mounting structure or bracket for mounting a skier's boots to the unitary ski.

Known difficulties encountered when using conventional skis include: maintaining an ideal body position, which varies according to speed and running conditions; displacing body weight from one ski to the other and exercising command of the ski edges associated with such body displacement; guiding the skis, particularly maintaining them in parallel relation; and adapting the position of the skis and the position of the body to the terrain and the course to be followed. These difficulties are exacerbated if the skier is physically handicapped and therefore is not able to exert equal control over both skis.

In any event, these difficulties usually are encountered by the novice skier. Initially a great amount of strength and concentration is needed, which causes fatigue and diminishes the distance and duration of the traverse and the pleasure of skiing. When skiing over undulated ground, for example, particularly when crossing undulations other than perpendicularly, considerable effort is required to maintain the skis parallel to each other. The novice skier frequently experiences considerable difficulties in learning to keep the skis in parallel position. When the skis are not maintained in exact parallelism, one or the other ski does not move exactly in a longitudinal direction but skids laterally, which causes fatigue and slows the speed.

In view of the difficulties experienced by physically handicapped skiers and novice skiers in controlling conventional skis, various configurations for a monoski have been developed. However, known monoskis have certain disadvantages.

One known monoski comprises a supporting plate to which ski bindings, including toe and heel portions, are screwed as shown in Freegard, U.S. Pat. No. 3,802,714. Freegard, U.S. Pat. No. 3,802,714 discloses a single raised ski boot mounting platform mounted to a ski. This monoski is substantially rigid in its middle section which carries the supporting plate for the ski bindings, and this rigid section is followed in front and at the rear thereof by a section having the elasticity and flexibility for proper running performance. The rigid section of the monoski disclosed in Freegard, U.S. Pat. No. 3,802,714, does not allow for absorption of upward and downward deflection of the ski. This inherent problem of this monoski is due to the mounting of the rigid supporting plate for the ski bindings, which can be compared with a structural builtup beam. The discontinuous transitions of the elastic properties of the monoski disclosed in Freegard, U.S. Pat. No. 3,802,714, result in undesirable running performance and also in a loosening or tearing off of the screws by means of which the supporting plate is affixed to the ski, thereby rendering the monoski unfit after a short life of use.

Schmid, U.S. Pat. No. 3,685,846, and Fish, U.S. Pat. No. 3,854,738, disclose monoskis including separate mounting platforms mounted to a ski so that a downhill skier can ski on snow with only one ski. These monoskis include two ski boot mounting platforms to which ski bindings are attached for respectively securing the toe and heel of each of the skier's boots. The monoski disclosed in Schmid, U.S. Pat. No. 3,685,846, can include resilient material in the form of rubber or, alternatively, springs on which the front and rear mounting platforms are mounted. Although the monoskis disclosed in Schmid, U.S. Pat. No. 3,685,846, and Fish, U.S. Pat. No. 3,854,738, can provide for independent absorption of upward and downward deflection of the ski, particularly the monoski disclosed in Schmid since the front and rear mounting platforms are mounted on resilient material or springs, the front and rear mounting platforms are a weak configuration and therefore do not provide adequate securement of the skier's boots because the mounting platforms are not interconnected, except by the ski. Consequently, the skier's boots can release from the front and rear mounting platforms of these monoskis during normal skiing, especially during skiing over rough packed snow, thereby causing a fall which can endanger the safety of the skier.

SUMMARY OF THE INVENTION

According to this invention, a ski boot mounting structure or bracket for a monoski is provided, including forward and rear ski boot mounting platforms, to which ski bindings are attached for respectively securing the toe and heel of each of the skier's ski boots, and further including a flexible member, preferably a leaf spring, which interconnects the forward and rear mounting platforms. The leaf spring is adjusted in length in correspondence with ski boot size.

In accordance with one embodiment of the invention, a monoski is provided comprising an elongated ski with a longitudinally extending running surface and longitudinally extending control edges along opposite edges of the running surface and a mounting structure mounted generally centrally on the ski providing a raised platform above the ski and having ski boot binding means for supporting a monoskier on the raised platform at an elevated position above the running surface of the ski for monoskiing, the mounting structure comprising forward and rear platform elements interconnected by a flexible member. Preferably, the distance of the raised platform above the ski is such that the angle defined by the intersection of the plane of the running surface of the ski and a plane which includes one of the control edges of the running surface and the outboard edges of the platform elements is approximately 60°.

The flexible member, preferably a leaf spring, strengthens the ski boot mounting structure and absorbs both upward and downward deflection of the ski along the longitudinal axis of the ski. The ski boot mounting structure according to this invention is as easy to mount on a ski as standard ski bindings are mounted on standard skis in ski shops today.

BRIEF DESCRIPTION OF THE DRAWINGS

The above and other features of the invention and the concomitant advantages will be better understood and appreciated by those skilled in the art in view of the description of the preferred embodiments given below in conjunction with the accompanying drawings. In the drawings.

DESCRIPTION OF THE PREFERRED EMBODIMENTS

Figure 1:
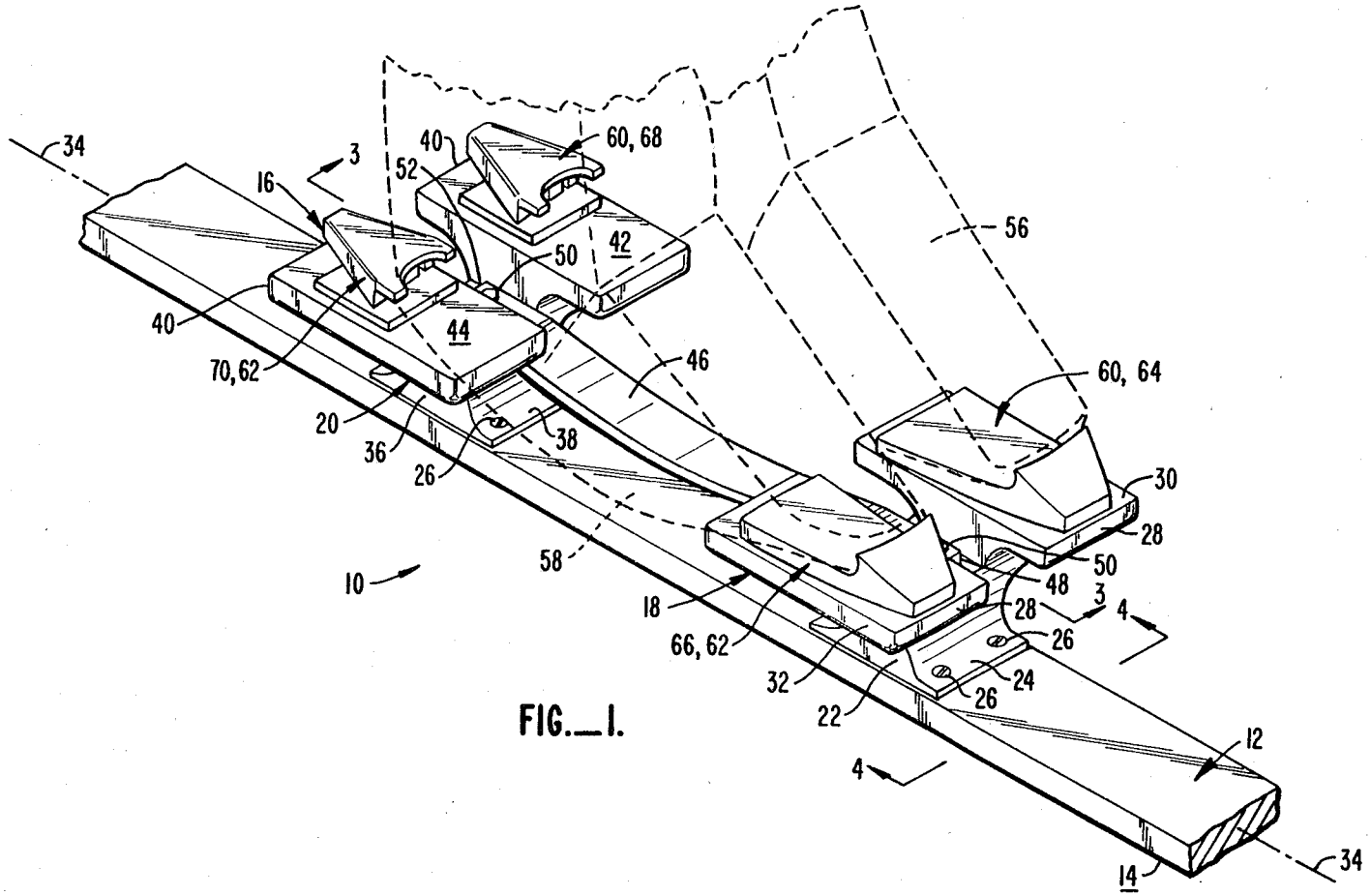
FIG. 1 is a perspective view of a monoski in accordance with an embodiment of the invention.
Figure 2:
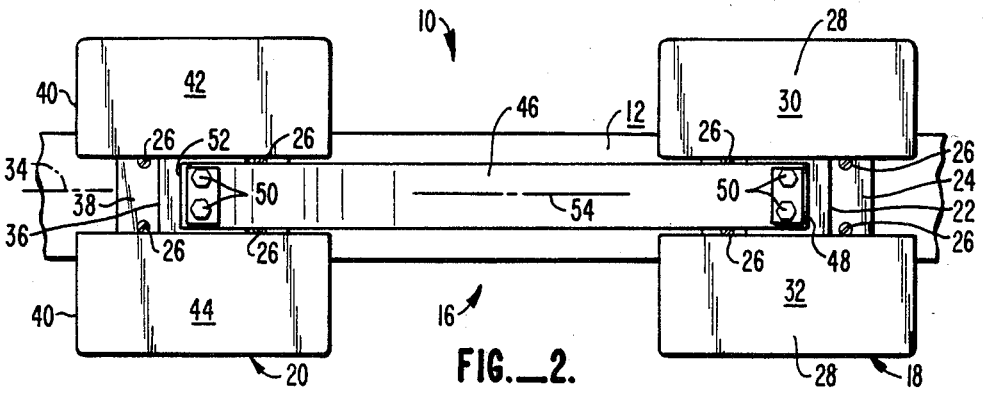
FIG. 2 is a top elevational view of the monoski shown in FIG. 1.
Figure 3:
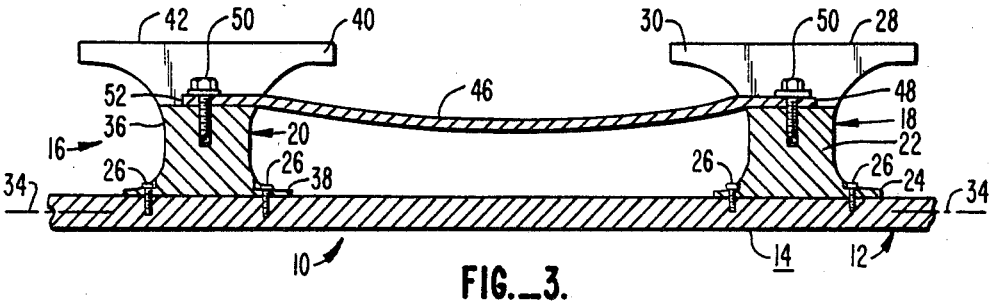
FIG. 3 is a longitudinal section of the monoski shown in FIG. 1 along line 3—3.

Referring now to the drawings in detail, a monoski 10 incorporating an embodiment of this invention is shown in FIG. 1. The monoski 10 preferably includes a ski 12 having approximately the shape of a conventional downhill or alpine ski with a lower running surface 14.

The monoski 10 also includes a mounting structure or bracket 16 having forward and rear platform elements 18 and 20, respectively. The forward platform element 18 includes a platform support or pedestal 22 including a base 24 secured to the ski 12 by suitable fasteners 26, such as screws. The forward platform element 18 also includes a raised bifurcated platform 28. The bifurcated platform 28 is preferably integral with the forward platform support or pedestal 22 for supporting the bifurcated platform 28 above and generally parallel to the base 24. The bifurcated platform 28 comprises side-by-side flanges 30 and 32 which extend outwardly from the longitudinal axis 34 of the ski 12. The bifurcated platform 28 can generally have a width greater than the width of the ski 12 and lies centrally over the longitudinal axis 34 of the ski.

The rear platform element 20 includes a rear platform support or pedestal 36 constructed like the forward platform support or pedestal 22 and which similarly includes a base 38 secured to the ski 12 by suitable fasteners 26. The rear platform element 20 also includes a raised bifurcated platform 40. The bifurcated platform 40 is preferably integral with the rear platform support or pedestal 36 for supporting the bifurcated platform 40 above and generally parallel to the base 38. The bifurcated platform 40 comprises side-by-side flanges 42 and 44 which extend outwardly from the longitudinal axis 34 of the ski 12. The bifurcated platform 40 is substantially the same width as the bifurcated platform 28 and is at substantially the same height above the ski 12 as the bifurcated platform 28. The bifurcated platforms 28 and 40 therefore cooperate to form a skier support platform raised above the ski 12.

Each of the platform elements 18 and 20 has the profile of a Y. Each of the platform supports or pedestals 22 and 36 is preferably formed integral with the respective bifurcated platforms 28 and 40. Each of the platform elements 18 and 20 can be formed as an integral molded part, for example, cast or machined from a lightweight alloy or injection molded from high-strength plasticized material or, alternatively, can be assembled from semi-finished material available in commerce, i.e., from plates and profiles, for example, by welding or riveting.

According to this invention, the monoski 10 includes the mounting structure 16 in which the forward and rear platform elements 18 and 20 mounted to the ski 12 are interconnected by a flexible member 46, such as a leaf spring, for example, constructed from 1020 carbon spring steel or fiberglass or, alternatively, high-strength plastic. The flexible member 46 preferably has one end 48 connected to the forward platform support or pedestal 22 by fasteners 50, such as bolts. The other end 52 of the flexible member 46 is preferably similarly connected to the rear platform support or pedestal 36 by fasteners 50. The center line 54 of the flexible member 46 preferably lies in a vertical plane along the longitudinal axis 34 of the ski 12 and perpendicular to the ski. The flexible member 46 varies in length with variance in ski boot size.

The elasticity and flexibility of the ski 12 is not significantly reduced, since the mounting structure 16 comprising the forward and rear platform elements 18 and 20 interconnected by the flexible member 46 barely increases the rigidity of the ski. The feature of flexibly interconnected forward and rear platform elements for providing strength and absorbing upward and downward deflection found in the monoski according to this invention provides proper running performance. That is, the mounting structure 16 supporting the skier is so formed that the ski 12 provided with the running surface 14 practically does not present any rigid section.

The bifurcated platforms 28 and 40 of the respective forward and rear platform elements 18 and 20 form the supporting surface for the soles of the skier's boots 56 and 58. As shown in FIG. 1, a pair of conventional ski bindings 60 and 62 is mounted on the bifurcated platforms 28 and 40 to provide for attaching the monoski 10 to a skier with his ski boots 56 and 58 in close side-by-side association. Each of the ski bindings 60 and 62 includes a forward or toe binding 64 and 66, respectively, mounted on the forward end of the forward platform element 18 and a step-in rear or heel binding 68 and 70, respectively, mounted on the rear platform element 20. The toe bindings 64 and 66 are affixed to the bifurcated platform 28, and the heel bindings 68 and 70 are affixed to the bifurcated platform 40. The heel bindings 68 and 70 can be longitudinally adjustable on the rear platform element 20 to accommodate a range of different ski boot sizes.

The ski bindings 60 and 62 are shown as being safety checks and automatic heel release devices. However, any conventional ski bindings can be secured to the monoski 10, for example, bindings having lateral sole engaging jaws and a heel engaging cable with a tensioning device that meet all DIN requirements.

Figure 4:
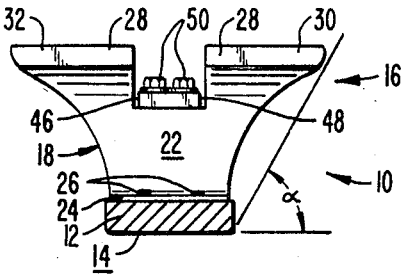
FIG. 4 is a transverse section of the monoski shown in FIG. 1 along line 4—4.

In order to facilitate the action of the control edges of the ski 12 during running and to keep the width of the ski on the order of magnitude of a conventional ski without having the sole edges of the skier's boots 56 and 58 making contact with the snow when laterally inclining the monoski 10 during running in a curve, it is convenient to provide the ski boot supporting surface on the toe and heel portions of the ski bindings 60 and 62 at a distance above the ski corresponding substantially to the width of the ski. The distance of the bifurcated platforms 28 and 40 above the ski 12 is preferably such that the angle $\alpha$ shown in FIG. 4, that is, the angle defined by the intersection of the plane of the running surface 14 of the ski and a plane which includes one of the control edges of the running surface and the outboard edges of the bifurcated platforms 28 and 40, is approximately 60°.

The ski 12 provided with the running surface 14 can be formed by a conventional ski, i.e., having a width from 7 to 10 centimeters and a length of about 190 centimeters when the ski is destined to be used by a person of about 175 centimeters height, although it is desirable that the length of this ski is somewhat longer than that of a conventional ski. For a length of a conventional ski of 190 centimeters, the length of the ski 12 can be from 195 to 210 centimeters.

It will be understood that the monoski according to this invention is particularly suitable for running downhill. However, the skier can use conventional ski poles or outriggers for easily moving over flat ground, since the frictional resistance against gliding of the monoski according to this invention is less than that of a pair of conventional skis.

While various embodiments of a mounting structure for a monoski have been described in order to make the invention understandable to those skilled in the art, it will be appreciated that variations and modifications not mentioned will become apparent to those skilled in the art. It is to be clearly understood that the above description is by way of illustration and example only and is not to be taken by way of limitation. Accordingly, the spirit and scope of this invention are ascertainable only by reference to the appended claims.

What is claimed is:

1. A monoski comprising an elongated ski with a longitudinally extending running surface and longitudinally extending control edges along opposite edges of the running surface and a mounting structure mounted generally centrally on the ski providing a raised platform above the ski and having ski boot binding means mounted on the platform for supporting both feet of a monoskier on the raised platform at an elevated position above the running surface of the ski for monoskiing, the mounting structure comprising forward and rear platform elements non-relasably mounted on the ski and which are interconnected by a flexible member disposed at a distance above the ski such that the flexible member remains elevated above the ski during deflection of the ski, whereby the flexible member strengthens the mounting structure and permits both upward and downward deflection of the ski along the longitudinal axis of the ski while absorbing said deflection.

2. The monoski according to claim 1 wherein the ski boot binding means provides for attachment of the monoski to a pair of ski boots in side-by-side association of the raised platform and generally centered over the longitudinal axis of the ski.

3. The monoski according to claim 1 wherein the distance of the raised platform above the ski is such that the angle defined by the intersection of the plane of the running surface of the ski and a plane which includes one of the control edges of the running surface and the outboard edges of the platform elements is, approximately 60°.

4. The monoski according to claim 1 wherein the mounting structure is affixed to the ski by fastener means situated on a line extending transversely to the longitudinal axis of the ski.

5. The monoski according to claim 1 wherein the flexible member is a leaf spring.

6. The monoski according to claim 1 wherein the flexible member is a flat spring element whose width is relatively greater that its thickness and which is downwardly concave in a relaxed state.

7. A monoski having a ski formed with a longitudinally extending running surface, a pair of ski bindings affixed to the ski in side-by-side association, each of the ski bindings having a toe portion and a heel portion, wherein the improvement comprises a platform for mounting the toe portions and a separate platform for mounting the heel portions for supporting both feet of a monoskier, the platforms being non-releasably mounted one behind the other in longitudinally spaced relation on the ski, the platforms being interconnected by a flexible member disposed at a distance above the ski such that the flexible member remains elevated above the ski during deflection of the ski, whereby the flexible member strenghthens the platforms and permits both upward and downward deflection of the ski along the longitudinal axis of the ski while absorbing said deflection.

8. The monoski according to claim 7 wherein the platforms are each formed with a ski boot supporting surface spaced above the ski.

9. The monoski according to claim 8 wherein the distance of the platform above the ski is such that the angle defined by the intersection of the plane of the running surface of the ski and a plane which includes one of the control edges of the running surface and the outboard edges of the platforms is approximately 60°.

10. The monoski according to claim 7 wherein the platforms are affixed to the ski by fastener means situated on a line extending transversely to the longitudinal axis of the ski.

11. The monoski according to claim 7 wherein the flexible member is a leaf spring.

12. The monoski according to claim 7 wherein the flexible member is a flat spring element whose width is relatively greater that its thickness and which is downwardly concave in a relaxed state.

13. In a monoski comprising an elongated ski with a longitudinally extending running surface, forward and rear platform elements on the ski having forward and rear platforms collectively providing a raised platform above the ski, and ski boot binding means mounted on the platform elements for selectively supporting both feet of a skier on the raised platform, the improvement wherein the forward and rear platform elements comprise forward and rear platform supports on the ski for forward and rear bifurcated platforms, respectively, the platform supports being non-releasably mounted on the ski and being interconnected by a flexible member, the flexible member being disposed at a distance above and spaced from the ski such that the flexible member remains elevated above the ski during deflection of the ski, the bifurcated platforms for supporting a skier with the ski boot binding means mounted on the bifurcated platforms, whereby the flexible member strengthens the bifurcated platforms and permits both upward and downward deflection of the ski along the longitudinal axis of the ski while absorbing said deflection.

14. The monoski according to claim 13 wherein the ski boot binding means provides for attachment of the monoski to a pair of ski boots in side-by-side association on the raised platform and generally centered over the longitudinal axis of the ski.

15. The monoski according to claim 13 wherein the flexible member is a flat spring element whose width is relatively greater than its thickness and which is downwardly concave in a relaxed state.

16. A monoski comprising an elongated ski with a longitudinally extending running surface and a mounting structure with forward and rear longitudinally spaced platform elements mounted on the ski respectively having forward and rear platform supports each including a bifurcated platform collectively providing a raised platform above the ski for attachment of ski boot binding means for selectively supporting both feet of a skier at an elevated position on the raised platform and with the platform elements non-releasably mounted on the ski and which are interconnected by a flexible member disposed at a distance above the ski such that the flexible member remains elevated above the ski during deflection of the ski, whereby the flexible member strengthens the raised platform and permits both upward and downward deflection of the ski along the longitudinal axis of the ski while absorbing said deflection.

17. The monoski according to claim 16 wherein the ski boot binding meansprovides for attachment of the monoski to a pair of ski boots in side-by-side association on the raised platform and generally centered over the longitudinal axis of the ski.

18. The monoski according to claim 16 wherein the flexible member is a flat spring element whose width is relatively greater than its thickness and which is downwardly concave in a relaxed state.

* * * * *